United States Patent [19]

Vitek

[11] 4,128,418

[45] Dec. 5, 1978

[54] ENHANCED GRAIN GROWTH IN ARSENIC MODIFIED COPPER-ZINC BRASSES

[75] Inventor: John M. Vitek, Cheshire, Conn.

[73] Assignee: Olin Corporation, New Haven, Conn.

[21] Appl. No.: 814,195

[22] Filed: Jul. 11, 1977

[51] Int. Cl.[2] ..... C22C 9/04

[52] U.S. Cl. ..... 75/157.5; 148/11.5 C

[58] Field of Search ..... 75/157.5, 153; 148/13.2, 11.5 R, 2, 12.7 C, 11.5 C, 32, 32.5, 160

[56] References Cited

U.S. PATENT DOCUMENTS

| | | | |
|---|---|---|---|
| 2,118,688 | 5/1938 | Webster | 75/157.5 |
| 2,229,622 | 1/1941 | Bunn | 75/157.5 |
| 3,634,076 | 1/1972 | Foerster | 75/157.5 |
| 4,015,982 | 4/1977 | Saito et al. | 75/157.5 |

FOREIGN PATENT DOCUMENTS

| | | | |
|---|---|---|---|
| 139843 | 5/1961 | U.S.S.R. | 75/157.5 |

*Primary Examiner*—L. Dewayne Rutledge
*Assistant Examiner*—Peter K. Skiff
*Attorney, Agent, or Firm*—Paul Weinstein

[57] ABSTRACT

A copper-zinc brass alloy is disclosed which exhibits enhanced grain growth characteristics when modified with from 0.02 to 0.80 percent by weight arsenic.

3 Claims, No Drawings

ENHANCED GRAIN GROWTH IN ARSENIC MODIFIED COPPER-ZINC BRASSES

BACKGROUND OF THE INVENTION

The present invention relates to brass alloys, more particularly, copper-zinc brass alloys which exhibit enhanced grain growth characteristics when modified with arsenic.

During the processing of brasses from which deep drawn shell casings and other articles are made, it is desirable to produce alloys of coarse grain size. The specific grain size which is desired is produced by controlling the recrystallization annealing treatment. In order to reduce the cost of heat treating, and to increase productivity and furnace life, it would be desirable to lower the temperature necessary to produce a desired grain size.

The use of arsenic as an alloying element in copper base alloys is well known for the purposes of dezincification and improving corrosion resistant characteristics. For example, arsenic has been added to admiralty brass, that is a copper-zinc-tin brass, in a range of 0.02 to 0.10 percent by weight to inhibit dezincification and enhance corrosion resistance. It has been found that arsenic, when added to copper-zinc-tin alloys, segregates to grain boundaries and thereby inhibits grain boundary related corrosion. It has been found that when the arsenic is segregated to the grain boundaries in copper-zinc-tin alloys, the grain growth characteristics of the alloy is retarded.

In addition to the above, arsenical copper, that is copper where arsenic is added in a range of from 0.15 to 0.50 percent by weight, has also been shown to have retarded grain growth. The presence of the arsenic is denoted by smaller grain sizes which leads to lower ductility unless annealing temperatures are raised. Likewise, arsenic has been added to aluminum bronze alloys to improve the corrosion resistant characteristics thereof but again grain growth retardation has been experienced.

SUMMARY OF THE INVENTION

In accordance with the present invention, brasses, in particular copper-zinc brasses, are modified by the addition of arsenic in the range of from 0.02 to 0.8 percent by weight so as to obtain an alloy possessing the wholly unexpected characteristic of enhanced grain growth.

Accordingly, it is a principal object of the present invention to provide an arsenic modified copper-zinc brass which exhibits enhanced grain growth characteristics.

A further object of the present invention is to provide a copper-zinc brass in which specific grain sizes can be obtained at annealing temperatures lower than those heretofore known.

Still a further object of the present invention is to provide a copper-zinc brass which is capable of being annealed at lower temperatures and thereby increase the productivity and life of the annealing furnace.

Further objects and advantages will be apparent after consideration of the invention with reference to the description.

DETAILED DESCRIPTION

In accordance with the present invention, the foregoing objects and advantages may be readily obtained.

The alloys of the present invention are copper base alloys comprising arsenic and zinc, with the balance essentially copper. The arsenic content ranges from about 0.02 to 0.8 percent by weight and preferably about 0.3 to 0.5 percent by weight, and the zinc content ranges from about 8.0 to 34.0 percent by weight and preferably about 25.0 to 34.0 percent by weight. Quantities of arsenic less than those specified above are insufficient to insure an appreciable increase in the rate of grain growth while the use of quantities in excess of the above specified values offer little or no increase in benefit.

The present invention utilizes arsenic as an alloying element in copper-zinc brasses to enhance the grain growth characteristics thereof. By the addition of arsenic in the amounts specified, the recrystallization annealing treatment can be carried out at lower temperatures and thereby reduce costs of heat treating, and increase productivity and furnace life. The resulting alloy exhibits good creep resistance characteristics and is particularly suitable for deep drawing applications. The enhanced grain growth characteristics of the arsenic modified copper-zinc brasses is totally unexpected since the addition of arsenic to other copper base alloys as well as copper itself has been observed to be a grain growth inhibitor.

The present invention will be more readily understandable from a consideration of the following example.

Alloys were prepared by melting copper and adding the elemental additions. After stirring for 1 or 2 minutes, the melts were poured through a tundish into a chilled mold. Two brasses were cast as 10-pound ingots. The composition of one of the brass alloys was Cu-30 Zn wherein the second was modified with a 0.4 percent by weight arsenic addition. The processing of the two ingots was identical and included hot rolling the alloys at a temperature range of between 300° to 800° C., the samples were then subjected to cold rolling and annealing sequences in preparation for subsequent testing. The alloys were subsequently subjected to a 57% cold rolling operation and given a recrystallization anneal at various temperatures after which the grain sizes were measured. The alloys were annealed at temperatures of 425° C., 475° C., 525° C. and 575° C. The results of the effect of temperature on grain growth in the two alloys are presented in Table I, below.

TABLE I

| | Annealing Temperature (One Hour Anneal) | | | |
|---|---|---|---|---|
| Composition | 425° C | 475° C | 525° C | 575° C |
| Cu-30 Zn | 0.012 | 0.021 | 0.035 | 0.048 |
| Cu-30 Zn-0.4 As | 0.016 | 0.031 | 0.056 | 0.070 |

Referring to Table I, it can be seen that a grain size of about 50$\mu$ can be obtained in the arsenic modified brass at annealing temperatures which are 50° C. lower than those necessary to obtain an equivalent grain size in the copper-zinc brass which is not modified by arsenic. It is expected that this improved grain growth would occur in arsenic modified copper-zinc brasses which are cold worked between 8 and 95%. The zinc content may vary from about 8.0 to 34.0 percent by weight and the levels of arsenic from 0.02 to 0.8 percent by weight. It should be noted that the amount of arsenic which is added to a particular copper-zinc alloy should not exceed that amount which will result in an arsenic precipitate. It is well known that the formation of a precipitate would result in grain growth retardation.

Additional samples were prepared from the two cast ingots and subjected to recrystallization annealing treatments to produce approximately equivalent grain sizes. The samples were then subjected to a 35% and a 60% cold rolling operation and then tested for mechanical properties. The results of these tests are set forth below in Table II.

TABLE II

| Alloy | % Cold Rolled | Ultimate Tensile Strength, KSI | 0.2% Yield Strength, KSI | % Elongation |
|---|---|---|---|---|
| Cu-30 Zn | 35% | 80.6 | 71.0 | 7.9 |
| Cu-30 Zn-0.4 As | 35% | 80.4 | 72.5 | 8.5 |
| Cu-30 Zn | 60% | 85.7 | 3.0 | |
| | 98.6 | | | |
| Cu-3: Zn-0.4 As | 60% | 100.9 | 87.8 | 2.0 |

From the above Table, it can be seen that the alloys of the present invention achieve slightly superior levels of strength while maintaining comparable ductility with savings in the cost of heat treating.

The alloys of this invention have particular application in the production of articles through a deep drawing process such as shell casings and the like.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A brass alloy having deep drawing properties and exhibiting enhanced grain growth consisting of from about 8.0 to about 34.0 weight percent zinc, from about 0.4 to about 0.8 weight percent arsenic and the remainder copper, said alloy exhibiting a grain size of at least about 50 microns after cold rolling at least 57% and annealing at a temperature of 525° C. for 1 hour.

2. A brass alloy according to claim 1 wherein said arsenic is present in the amount of about 0.4 to 0.5 weight percent.

3. A brass alloy according to claim 1 wherein said zinc is present in the amount of about 25.0 to 34.0 weight percent.

* * * * *

UNITED STATES PATENT AND TRADEMARK OFFICE

CERTIFICATE OF CORRECTION

PATENT NO. : 4,128,418

DATED : December 5, 1978

INVENTOR(S) : John M. Vitek

It is certified that error appears in the above—identified patent and that said Letters Patent is hereby corrected as shown below:

In Column 3, TABLE II, in the line beginning "Cu-30 Zn" in the second column change "85.7" to ---98.6---; in the third column change "3.0" to ---85.7---; and in the fourth column insert ---3.0---;

In Column 3, TABLE II, in the line beginning "Cu-30 Zn" in the first column under "60%" delete "98.6";

In Column 3, TABLE II, the line beginning "Cu-3: Zn-0.4 As" should read ---Cu-30 Zn-0.4 As---.

Signed and Sealed this

*Thirty-first* Day of *August 1982*

[SEAL]

*Attest:*

GERALD J. MOSSINGHOFF

*Attesting Officer*

*Commissioner of Patents and Trademarks*